US006233551B1

(12) United States Patent
Cho et al.

(10) Patent No.: US 6,233,551 B1
(45) Date of Patent: May 15, 2001

(54) METHOD AND APPARATUS FOR DETERMINING MULTIBAND VOICING LEVELS USING FREQUENCY SHIFTING METHOD IN VOCODER

(75) Inventors: Yong-duk Cho, Yongin; Moo-young Kim, Sungnam, both of (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/296,242

(22) Filed: Apr. 22, 1999

(30) Foreign Application Priority Data

May 9, 1998 (KR) ..... 98-16629

(51) Int. Cl.[7] ..... G10L 11/06
(52) U.S. Cl. ..... 704/208; 704/217
(58) Field of Search ..... 704/203, 205, 704/207, 208, 214, 216, 217

(56) References Cited

U.S. PATENT DOCUMENTS

| | | | | |
|---|---|---|---|---|
| 5,216,747 | * | 6/1993 | Hardwick et al. | 704/208 |
| 5,583,784 | * | 12/1996 | Kapust et al. | 704/203 |
| 5,809,453 | * | 9/1998 | Hunt | 704/214 |
| 5,826,222 | * | 10/1998 | Griffin | 704/207 |
| 5,890,108 | * | 3/1999 | Yeldener | 704/208 |
| 6,023,671 | * | 2/2000 | Iijima et al. | 704/214 |

OTHER PUBLICATIONS

Cho et al., "A spectrally mixed excitation (SMX) vocoder with robust parameter determination," Proceedings of the 1998 IEEE International Conference on Acoustics, Speech and Signal Proceeding, vol. 2, May 1998, pp. 601 to 604.*

Beraldin et al., "Overflow analysis of a fixed–point implementation of the Goertzel algorithm," IEEE Transactions on Circuits and System, vol. 36, Issue 2, Feb. 1989, pp. 322 to 324.*

Kim et al., "Use of spectral autocorrelation in spectral envelope linear prediction for speech recognition," IEEE Transactions on Speech and Audio Proceeding, vol. 7, Issue 5, Sep. 1999, pp. 533 to 541.*

* cited by examiner

*Primary Examiner*—William R. Korzuch
*Assistant Examiner*—Martin Lerner
(74) *Attorney, Agent, or Firm*—Burns, Doane, Swecker & Mathis, LLP

(57) ABSTRACT

A method and an apparatus for determining multiband voicing levels using a frequency moving method in a vocoder are provided. The method for determining the multiband voicing levels using the frequency moving method according to the present invention in the vocoder includes the steps of (a) applying a window to an input voice signal and obtaining a power spectrum from a voice spectrum obtained by Fourier converting a windowed signal, (b) moving the frequency of each subband to an origin after dividing the power spectrum into a predetermined number of subbands, (c) obtaining autocorrelation values of the respective subbands by inverse Fourier converting the power spectrum the frequency of which is moved to the origin, and (d) normalizing the respective autocorrelation values and determining the voicing levels of the subbands from the normalized autocorrelation values.

5 Claims, 3 Drawing Sheets

METHOD AND APPARATUS FOR DETERMINING MULTIBAND VOICING LEVELS USING FREQUENCY SHIFTING METHOD IN VOCODER

BACKGROUND OF THE INVENTION

1. Field of the Invention

The present invention relates to a method for measuring a voicing level used in a vocoder, and more particularly, to a method and an apparatus for determining multiband voicing levels using a frequency shifting method in a vocoder, which determines a voicing level based on autocorrelation.

2. Description of the Related Art

In general, a voice is represented by a pitch, a voicing level, and a vocal tract coefficient in a vocoder of low bit ratio. The pitch and the voicing level are modeled by an excite signal and the vocal tract coefficient is modeled by a transfer function. Here, the voicing level denotes a degree to which a voiced sound is included in a voice signal. The voicing level is one of the most important parameters for expressing a voice and plays a considerable role in determining the quality of the voice which passed through the vocoder. Therefore, a voicing level measuring method used for the vocoder has been constantly searched.

Traditionally, the voicing level simply determined the whole band to be voiced or unvoiced. This was employed in the LPC10:DoD 2.4 kbit/s standard vocoder. Dividing the voicing levels in two parts remarkably deteriorates the quality of the vocoder. Recently, a method in which the quality of sound is much improved is used. For example, in a multiband excitation (MBE) vocoder, the whole band is divided into a predetermined number of subbands in the frequency band of the voice and the respective subbands are determined to be voiced and unvoiced. Also, in a sinusoidal transform coder (STC), an analyze signal is expressed as a value between 0 and 1 by measuring periodical strengths of the analyze signal. According to the strengths, the band of the lowband frequency is determined to be voiced and the band of the highband frequency is determined to be unvoiced.

Methods of differently expressing the voiced levels in each subband are widely known.

First, there is the above-mentioned MBE vocoder method. In the MBE vocoder method, after normalizing the sum of the square of a difference between a synthesized spectrum obtained through modeling under the assumption that the whole band is voiced and an original spectrum, the normalized value is compared with previously set threshold values, thus determining whether the concerned band is voiced or unvoiced. Second, there is an STC method. While the MBE vocoder method determines the voicing levels on the spectrum, in the STC method, after normalizing the sum of the square between a synthesized periodical signal and an original signal in a time axis signal, the normalized value is compared with previously set thresholds, thus determining a voiced and unvoiced cut-off frequency. A spectral band less than the cut-off frequency and that more than the cut-off frequency are respectively determined to be voiced and unvoiced. In the above two methods, the voice levels are determined in each subband by comparing the difference between the original signal (or spectrum) and a synthesized signal (or spectrum) with the threshold value in a frequency or a time axis.

Third, there is an autocorrelation method of a time envelope signal. In this method, the voice signal is bandpass filtered for calculating a firm autocorrelation value in high frequency subband the time envelope of the filtered signal is estimated, and a normalized autocorrelation value is calculated from the estimated signal. The voicing levels of the respective spectral subbands are determined on the basis of the autocorrelation value. Fourth, there is an autocorrelation method of an upsampling signal. In this method, a time resolution is compensated by dividing the voice signal in each subband and performing upsampling with respect to the high frequency band. The normalized autocorrelation value is obtained from the upsampled signal and the voicing level is determined on the basis of the normalized autocorrelation value.

In the above two methods, the voicing levels are determined in each subband on the basis of the autocorrelation method. This is based on the fact that the autocorrelation value is larger as the voicing level of a voice is higher. Here, it is important how to calculate the autocorrelation value in the high frequency subband in which many errors are generated in calculating the autocorrelation value.

SUMMARY OF THE INVENTION

To solve the above problem, it is an objective of the present invention to provide a method for determining multi-band voicing levels using a frequency moving method in a vocoder for effectively obtaining an autocorrelation value in a high frequency subband and more firmly and effectively determining the voicing levels by obtaining the autocorrelation value after moving the frequency to an origin in each subband, on the basis of an autocorrelation method using the frequency moving method.

It is another objective of the present invention to provide an apparatus for determining multiband voicing levels for performing the above method.

Accordingly, to achieve the first objective, there is provided a method for determining voicing levels using a frequency moving method in a vocoder, comprising the steps of (a) applying a window to an input voice signal and obtaining a power spectrum from a voice spectrum obtained by Fourier converting a windowed signal, (b) moving the frequency of each subband to an origin after dividing the power spectrum into a predetermined number of subbands, (c) obtaining autocorrelation values of the respective subbands by inverse Fourier converting the power spectrum the frequency of which is moved to the origin, and (d) normalizing the respective autocorrelation values and determining the voicing levels of the subbands from the normalized autocorrelation values.

To achieve the second objective, there is provided an apparatus for determining voicing levels using a frequency moving method in a vocoder, comprising a band dividing portion for dividing a power spectrum obtained from a voice spectrum with respect to an input voice signal into a predetermined number of subbands, a frequency moving portion for moving the frequencies of the respective divided subbands to an origin, an inverse Fourier converting portion for obtaining autocorrelation values of the respective subbands by converting the power spectrum the frequency of which is moved to the origin by an improved inverse Fourier method of Goertzel, and a voicing level determining portion for normalizing the respective autocorrelation values and determining the voicing levels of the respective subbands from the normalized autocorrelation values.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Hereinafter, a method for determining multiband voicing levels using a frequency moving method in a vocoder according to the present invention and the structure and the operation of an apparatus therefor will be described as follows with reference to the attached drawings.

Figure 1:
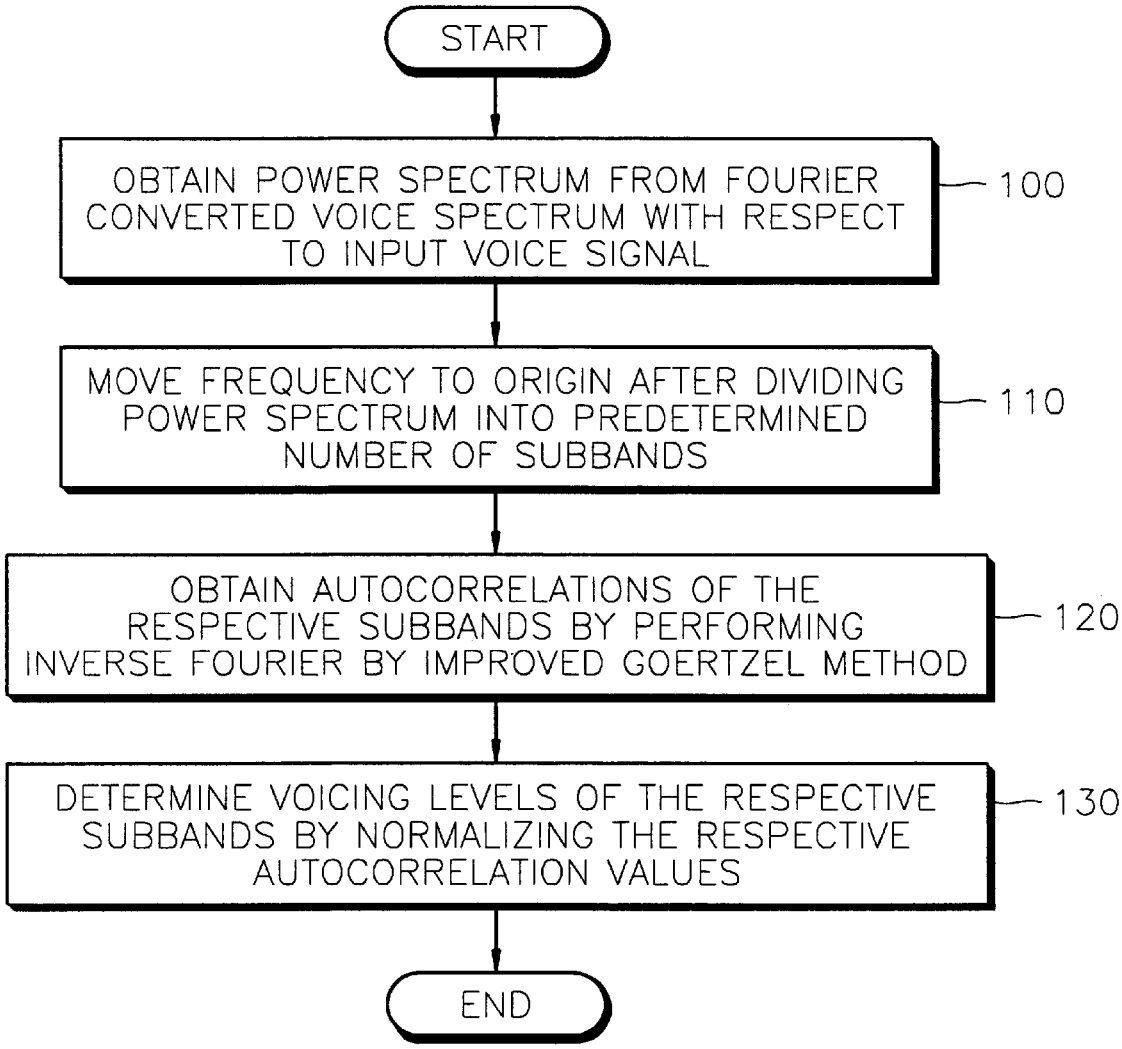
FIG. 1 is a flowchart for describing a method for determining multiband voicing levels using a frequency moving method according to the present invention.

FIG. 1 is a flowchart for describing a method for determining multiband voicing levels using a frequency moving method according to the present invention.

Figure 2:
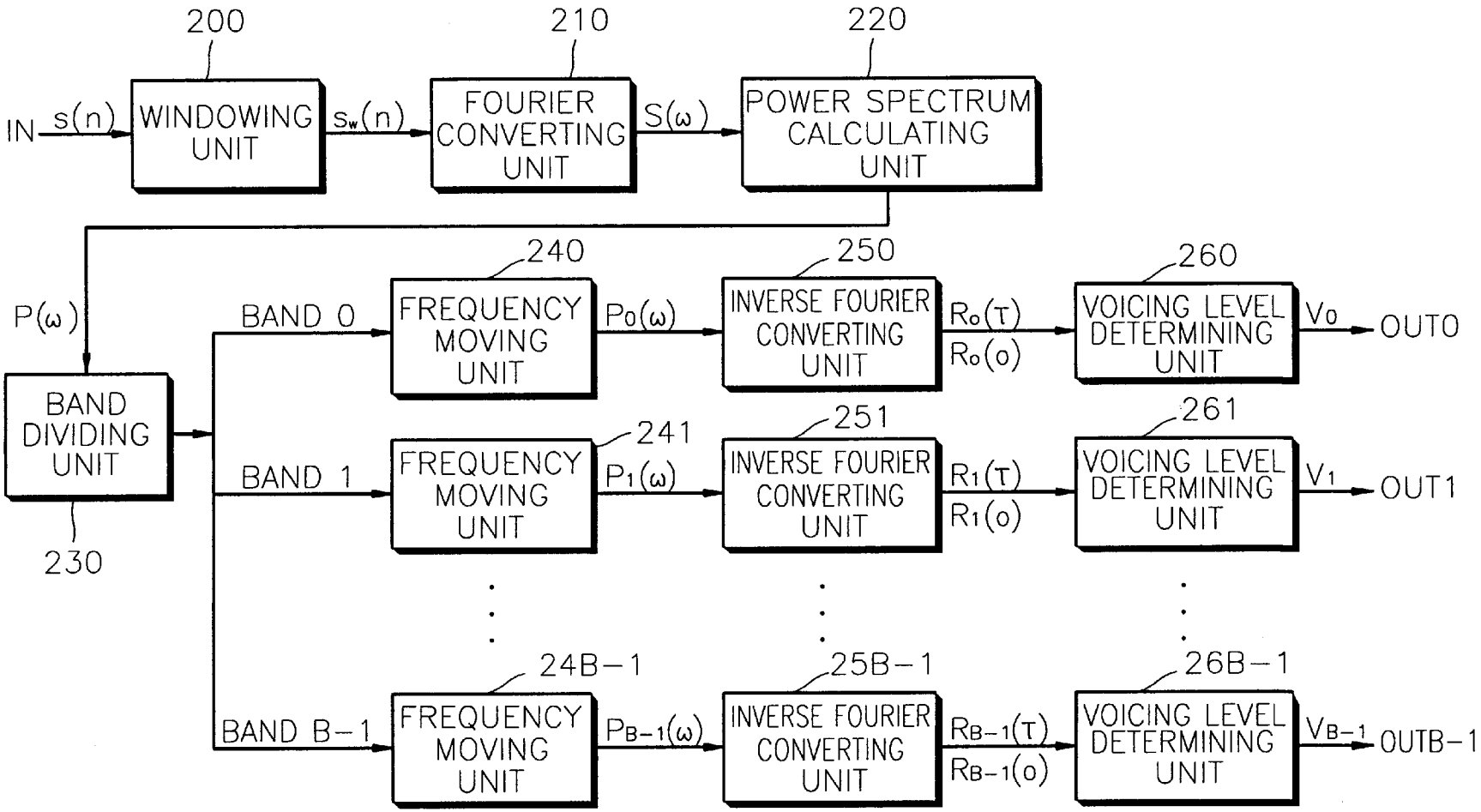
FIG. 2 is a block diagram of a preferred embodiment of an apparatus for determining the multiband voicing levels using the frequency moving method according to the present invention.

FIG. 2 is a block diagram of a preferred embodiment of an apparatus for determining the multiband voicing levels using the frequency moving method according to the present invention. The apparatus is comprised of a windowing unit 200, a Fourier converting unit 210, a power spectrum calculating unit 220, a band dividing unit 230, frequency moving units 240 through 24B–1, inverse Fourier converting units 250 through 25B–1, and voicing levels determining units 260 through 26B–1.

In the present invention, whether each subband of the multiband is voiced or unvoiced in a vocoder such as a sinusoidal vocoder is determined based on an autocorrelation method. Since the autocorrelation value is calculated after moving the band of the high frequency to the origin, the voicing levels are effectively determined with respect to a high frequency band.

To be specific with reference to FIGS. 1 and 2, a window is applied with respect to an input voice signal and the power spectrum is obtained from a voice spectrum obtained by Fourier converting the windowed signal (step 100).

Windows w(n) are applied in order to analyze input voice signals s(n) (n=0, 1, . . ., and N−1) in the frequency axis. Preferably, a Hamming window w(n) is used. In FIG. 2, an windowing unit 200 outputs the voice signals s(n) input through an input terminal IN as windowed signals sw(n) through the window w(n) (n=0, 1, . . ., and N−1). The Fourier converting unit 210 performs a Fourier conversion in order to convert the windowed signals $s_w(n)$ into frequency axes. Here, preferably, an M-point fast Fourier transform is used as a Fourier converting method for the efficiency of the calculation. The power spectrum calculating unit 220 calculates a power spectrum P(ω) from a voice spectrum S(ω) by the Fourier conversion. Namely, $$P(\omega)=|S(\omega)|^2((\omega=0, 1, \ldots, M/2).$$

After the step 100, after dividing the power spectrum into a predetermined number of subbands, the frequency is moved to the origin with respect to the respective subbands (step 110).

The band dividing unit 230 divides the power spectrum P(ω) calculated by the power spectrum calculating unit 220 into B (B is a natural number) subbands to be obtained. After performing division, the frequency moving method is used in the present invention in order to determine the voicing level of a bth subband (b=0, 1, . . ., and B−1). After dividing the calculated power spectrum into B subbands, the frequencies of the bands 0 through B−1 are moved to the origin in the corresponding frequency moving units 240 through 24B–1. The frequency of the bth power spectrum $P_b(\omega)$ moved to the origin can be preferably calculated using Equation 1.

$$P_b(\omega) = \begin{cases} P\left(\omega + \left\lfloor \left\lfloor \frac{Tb}{2B} + 0.5 \right\rfloor \frac{M}{T} + 0.5 \right\rfloor\right), & \text{if } 0 \le \omega \le \left\lfloor \left\lfloor \frac{T}{2B} + 0.5 \right\rfloor \frac{M}{T} + 0.5 \right\rfloor \\ 0, & \text{if } \left\lfloor \left\lfloor \frac{T}{2B} + 0.5 \right\rfloor \frac{M}{T} + 0.5 \right\rfloor < \omega \le M/2 \end{cases} \quad (1)$$

wherein, T and M respectively represent a pitch and an M-point when a Fourier conversion is performed by an M-point fast Fourier converting method in the Fourier converting unit 210. The pitch T can be obtained using a well known method. The power spectrum P(ω) output from the power spectrum unit 220 is divided into the B subbands by Equation 1 the frequency thereof is moved to the origin. According to Equation 1, the subband is not simply divided by a constant distance in the frequency axis but is divided on the basis of a vertex of an amplitude in a predetermined section and has a travel of (⌊LTb/2B+0.5⌋M/T+0.5) from the origin.

After the step 110, the autocorrelation value is obtained in each subband by inverse Fourier converting the power spectrum the frequency of which is moved to the origin by an improved Goertzel method (step 120).

In general, the autocorrelation value is obtained by inverse Fourier converting the power spectrum. However, the value required from the inverse Fourier conversion is the autocorrelation when a lag is 0 and the autocorrelation when the lag is the pitch. Since values are obtained with respect to the whole lags when a general Fourier conversion (for example, DFT and FFT) is performed, the calculation amount increases during the inverse Fourier conversion. The inverse Fourier conversion of Goertzel has an advantage in that the autocorrelation is obtained by a small amount of calculation when the Fourier conversion is performed with respect to a given point. In the present invention, the calculation amount is more effectively reduced by improving the inverse Fourier conversion of Goertzel.

When the inverse Fourier conversion is performed by the Goertzel's method, the inverse Fourier conversion is applied to the power spectrum when the autocorrelation value is to be obtained in the present invention. In the power spectrum, an imaginary part is 0 and a real part is symmetric. From such a characteristic, the autocorrelation $R_b(T)$ can be calculated using the inverse Fourier converting method improved as shown in Equation 2 when the lag is the pitch T.

$$R_b(T)=2(-1)^T y_T(M/2)-P_b(0)-(-1)^T P_b(M/2)$$

wherein, $$y_T(n)=v_T(n)-e^{-j2\pi T/M}v_T(n-1) \quad (2)$$

$$v_T(n)=2\cos(2\pi T/M)v_T(n-1)-v_T(n-2)+x(n)$$

$$v_T(-1)=v_T(-2)=0$$

wherein, T and M respectively correspond to a pitch and an M-point when a Fourier conversion is performed by an M-point fast Fourier converting method. Equations subsequent to $R_b(T)$ represent Equations according to the inverse Fourier converting method of Goertzel. The autocorrelation value $R_b(0)$ when the lag is 0 can be calculated as shown in Equation 3 according to the theorem of Parseval.

$$R_b(0) = \sum_{\omega=0}^{M} P_b(\omega) \tag{3}$$

In FIG. 2, inverse Fourier converting units 250 through 25B–1 inverse Fourier convert the respective power spectrums $P_0(\omega)$ through $P_{B-1}(\omega)$ by the improved Goertzel method and obtain the autocorrelations $R_0(T)$ through $R_{B-1}(T)$ when the lag is the pitch (T) and the autocorrelations $R_0(0)$ through $R_{B-1}(0)$ when the lag is 0 in each subband.

After the step 120, the autocorrelation values are respectively normalized and the voicing levels in the respective subbands are determined from the normalized autocorrelation values (step 130).

In order to distribute the autocorrelation value $R_b(T)$ of the bth subband, which can exist between a negative infinity to a positive infinity between −1 and 1, a normalized autocorrelation value $R_b'(T)$ is obtained with respect to each spectral subband from the autocorrelations $R_b(T)$ and $R_b(0)$ obtained from the step 120. At this time, the calculation can be performed using Equation 4.

$$R_b'(T) = \frac{M}{M-T}\frac{R_b(T)}{R_b(0)} \tag{4}$$

The voicing level $V_b$ of the bth subband is determined from the normalized autocorrelation value $R_b'(T)$. The voicing level $V_b$ is represented as Equation 5.

$$V_b = \begin{cases} 1, & R_b'(T) > TH1 \\ 0, & R_b'(T) < TH2 \\ \dfrac{R_b'(T) - TH2}{TH1 - TH2}, & \text{otherwise} \end{cases} \tag{5}$$

wherein, TH1 and TH2 represent threshold values between 0 and 1 previously determined through an experiment. The TH1 and the TH2 respectively represent an upper threshold value and a lower threshold value. Accordingly, when $V_b$=1, it means that the bth subband is completely voiced. When $V_b$=0, it means that the bth subband is completely unvoiced. In other cases, it is determined that voiced and unvoiced components are mixed. The values in the above three cases are represented in the above Equations. In FIG. 2, the voicing level determining units 260 through 26B–1 respectively obtain the normalized autocorrelation values from the autocorrelation values $R_0(T)$ through $R_{B-1}(T)$ and $R_0(0)$ through $R_{B-1}(0)$ with respect to the respective subbands, determine the voicing levels $v_0$ through $v_{B-1}$ in the respective subbands on the basis of the values, and output the voicing levels through output terminals OUTO through OUTB–1.

FIGS. 3A through 3D show simulation results for comparing the present invention with a conventional method.

Figure 3A:
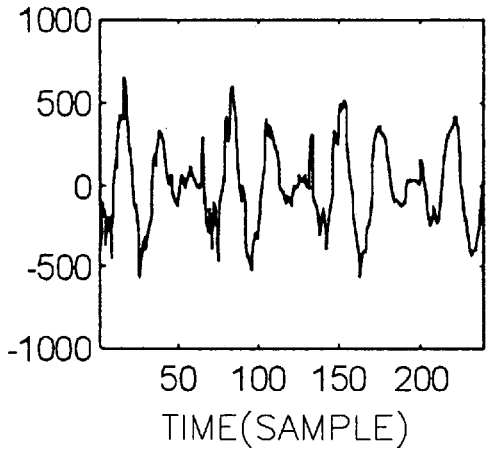
FIGS. 3A through 3D show simulation results for comparing the present invention to a conventional method.
Figure 3B:
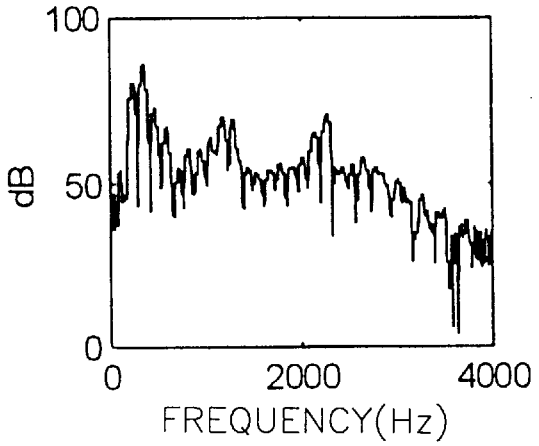
Figure 3C:
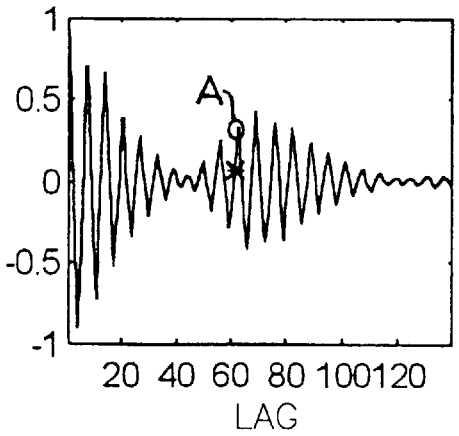
Figure 3D:
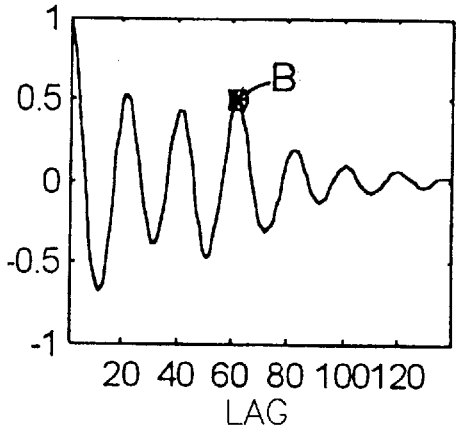

An experiment on the performance of the present invention will be described with reference to FIGS. 3A through 3D. FIG. 3A shows an original voice signal of the time axis. A sampling frequency at this time is 8,000 Hz. FIG. 3B shows a fast Fourier converted power spectrum. FIG. 3C shows a conventional autocorrelation value of a bandpass filtered signal (a band: 2,000 through 3,000 Hz). Here, the part marked with "A" denotes the autocorrelation value at the pitch T. The part marked with "*" denotes that the change of the autocorrelation value is very large when the pitch T is erroneously obtained by 1. FIG. 3D shows the autocorrelation value obtained by the present invention. When the present invention is used, it is noted that the change of the autocorrelation value is negligible though the pitch (the part marked with "*") is erroneously obtained by 1 with respect to the original pitch (the part marked with "B"). Namely, when noise is mixed with the voice, the pitch may be locally erroneously obtained, in particular, in the high frequency band. According to the present invention, the autocorrelation value is firmly obtained though noise is mixed.

The vocoder the sound quality of which is improved according to the method and apparatus for determining the voicing levels according to the present invention can be widely applied to the fields such as a vocoder for voice communication for a digital cellular phone, a vocoder for voice communication for a personal communication system (PCS), a vocoder for transmitting a voice message in a voice pager, a vocoder for a satellite communication, a vocoder for a VMS, and a vocoder for an e-mail. Other than these, there are many fields the above vocoder can be industrially applied.

As mentioned above, the method and apparatus for determining the voicing levels using the frequency moving method according to the present invention has advantages in that the autocorrelation value is effectively obtained in the high frequency subband, that the voicing levels are more firmly and effectively determined, and the autocorrelation is firmly obtained though the noise is mixed.

What is claimed is:

1. A method for determining voicing levels using a frequency moving method in a vocoder, comprising the steps of:

(a) applying a window to an input voice signal and obtaining a power spectrum from a voice spectrum obtained by Fourier converting a windowed signal;

(b) moving the frequency of each subband to an origin after dividing the power spectrum into a predetermined number of subbands;

(c) obtaining autocorrelation values of the respective subbands by inverse Fourier converting the power spectrum the frequency of which is moved to the origin; and (d) normalizing the respective autocorrelation values and determining the voicing levels of the subbands from the normalized autocorrelation values.

2. The method of claim 1, wherein, in the step (b), after dividing the power spectrum P(ω) into (B is a natural number) subbands, a bth (b=0 through B–1) power spectrum $P_b(\omega)$ the frequency of which is moved to an origin is calculated using Equation 1, wherein T and M respectively represent a pitch and an M-point when a Fourier conversion is performed by an M-point fast Fourier converting method in the step (a):

$$P_b(\omega) = \begin{cases} P\left(\omega + \left\lfloor\left\lfloor \frac{Tb}{2B} + 0.5\right\rfloor \frac{M}{T} + 0.5\right\rfloor\right), & \text{if } 0 \le \omega \le \left\lfloor\left\lfloor \frac{T}{2B} + 0.5\right\rfloor \frac{M}{T} + 0.5\right\rfloor \\ 0, & \text{if } \left\lfloor\left\lfloor \frac{T}{2B} + 0.5\right\rfloor \frac{M}{T} + 0.5\right\rfloor < \omega \le M/2. \end{cases} \tag{1}$$

3. The method of claim 1, wherein, in the step (c), with respect to B divided subbands, the autocorrelation value $R_b(T)$ of a bth power spectrum $P_b(\omega)$ the frequency of which is moved to an origin is calculated using an inverse Fourier converting method of Goertzel transformed as shown in Equation 2, wherein T and M respectively represent a pitch and an M-point when a Fourier conversion is performed by an M-point fast Fourier converting method in the step (a):

$$R_b(T)=2(-1)^T y_T(M/2)-P_b(0)-(-1)^T P_b(M/2)$$

wherein, $$y_T(n)=v_T(n)-e^{-j2\pi T/M}v_T(n-1) \quad (2)$$

$$v_T(n)=2\cos(2\pi T/M)v_T(n-1)-v_T(n-2)+x(n)$$

$$v_T(-1)=v_T(-2)=0.$$

4. The method of claim 3, wherein, in the step (c), an autocorrelation value $R_b(T)$ when a lag is a pit T and an autocorrelation value $R_b(0)$ when a lag is 0 are calculated, and wherein, in the step (d), an autocorrelation value $R_b'(T)$ normalized from the autocorrelation values $R_b(T)$ and $R_b(0)$ is determined to be voiced when the it is larger than a previously determined upper threshold value, to be unvoiced when it is smaller than a lower threshold value, and to be the mixture of voiced and unvoiced components in other cases, thus the voicing levels are determined in the respective subbands.

5. An apparatus for determining voicing levels using a frequency moving method in a vocoder, comprising:

a band dividing portion for dividing a power spectrum obtained from a voice spectrum with respect to an input voice signal into a predetermined number of subbands;

a frequency moving portion for moving the frequencies of the respective divided subbands to an origin;

an inverse Fourier converting portion for obtaining autocorrelation values of the respective subbands by converting the power spectrum the frequency of which is moved to the origin by an improved inverse Fourier method of Goertzel; and a voicing level determining portion for normalizing the respective autocorrelation values and determining the voicing levels of the respective subbands from the normalized autocorrelation values.

* * * * *